United States Patent [19]

Beck et al.

[11] 4,433,640

[45] Feb. 28, 1984

[54] ROTARY SPRAYERS FOR APPLYING UNIFORM COATS TO CONVEYOR SUPPORTED WORK

[75] Inventors: Alfred E. Beck, Exeter; Richard D. Cushing, Newton, both of N.H.

[73] Assignee: Circle Machine Co., Inc., Seabrook, N.H.

[21] Appl. No.: 251,868

[22] Filed: Apr. 7, 1981

Related U.S. Application Data

[63] Continuation-in-part of Ser. No. 211,282, Nov. 28, 1980, abandoned.

[51] Int. Cl.[3] ..... B05C 5/00

[52] U.S. Cl. ..... 118/323; 118/324

[58] Field of Search ..... 118/323, 324; 239/DIG. 1, 227, 236, 264; 134/172, 180, 181, 198

[56] References Cited

U.S. PATENT DOCUMENTS 2,397,482 4/1946 Griffin ..... 118/323

2,754,795 7/1956 Enssle ..... 118/323 X 4,151,808 5/1979 Beck et al. ..... 118/684

4,231,523 11/1980 Vikre ..... 239/570 X

FOREIGN PATENT DOCUMENTS 589479 3/1959 Italy ..... 118/323

*Primary Examiner*—John P. McIntosh

[57] ABSTRACT

A rotary sprayer has a rotor centrally of a conveyor and spaced therefrom with its axis normal thereto. The rotor supports a series of spray heads so spaced from its axis as to establish arcuate paths for them across the conveyor as the rotor is rotated. The spray is discharged to coat the work carried by the conveyor as the spray heads cross the conveyor and during such crossing their travel relative to the arcuate paths is so varied that the thickness of the deposited layer is substantially uniform wherever applied. The rotor has a chamber through which the spray material passes and which provides an air cushion absorbing momentary pressure increases occurring as the valves of the spray heads close and minimizing pressure drops as valves open.

11 Claims, 12 Drawing Figures

ROTARY SPRAYERS FOR APPLYING UNIFORM COATS TO CONVEYOR SUPPORTED WORK

The present application is a continuation-in-part of Ser. No. 211,282, filed Nov. 28, 1980 and now abandoned.

BACKGROUND REFERENCE

U.S. Pat. No. 2,397,482.

BACKGROUND OF THE INVENTION

Rotary sprayers are used to spray work carried along a conveyor. The work may consist of separate objects such as hides, parts thereof, pieces of sheet plastic or long lengths of various sheet materials, for examples.

Rotary sprayers have rotors or hubs spaced from the conveyor with their axes normal to the center thereof. A series of spray heads are carried by each rotor and are spaced therefrom to have arcuate spray paths intersecting the margins of the conveyor both upstream and downstream relative to the rotor axis. Spray is discharged from the spray heads as they cross the conveyor and the spray may be any fluent material or materials that may be used to color or to provide a protective coating or any other wanted treatment for the work.

The discharge of spray may be confined to either the upstream or the downstream path as well as to both paths and sprayers are available that discharge the spray material only when an object is in a position to receive spray from one or more spray heads.

Such a rotary sprayer is illustrated by U.S. Pat. No. 4,151,808 in which it is noted that the radial spacing of the spray heads from the rotor axis should be as great as is practicable in order to make the thickness of the deposited material as nearly uniform as possible wherever applied along the spray path or paths. It will be appreciated that as the radius of the arcuate paths increases, the amount of travel of the spray heads lengthwise of the conveyor decreases on both sides of the center of the conveyor relative its transverse travel. The maximum radial distance between the spray heads and the rotor axis is so limited for practical reasons, both of construction and space available for sprayer installations, that it has hitherto been necessary to accept a variation in the thickness of the deposited layers that results in a departure from ideal quality of the sprayed work and, in addition, a waste of spray material.

THE PRESENT INVENTION

The general objective of the present invention is to provide rotary sprayers that operate to so deposit the spray material that the thickness thereof is substantially uniform wherever applied by the spray heads as they cross the conveyor.

In accordance with the invention, this objective is attained by providing a connection between each spray head and the rotor that supports that head a predetermined distance from the rotor axis to provide arcuate paths across the conveyor upstream and downstream relative to the rotor axis. Each connection includes means operable to move the associated spray head in a predetermined varying manner relative to at least one of the arcuate paths such that the thickness of the sprayed layer is substantially uniform wherever spray is applied during the crossing of the conveyor.

In one embodiment of the invention, the means by which the relation of the spray heads is varied relative to the arcuate path or paths so affects the rate of spray head travel that it gradually decreases from a maximum adjacent one margin of the conveyor to a minimum centrally of the conveyor and then gradually increases to a maximum adjacent the other conveyor margin.

In another embodiment of the invention, the means by which the relation of the spray heads to the arcuate path or paths is varied effects the movement of each spray inwardly from a first position adjacent one margin of the conveyor so that its radial distance from the rotor axis is decreased to a minimum centrally of the conveyor and then is gradually increased until it is again spaced a maximum radial distance from the rotor axis adjacent the opposite margin of the conveyor.

In practice, in both embodiments, the means of each connection by which variations in the relation of a spray head to an arcuate path are effected includes a cam follower in engagement with a fixed cam.

In the embodiment of the invention first referred-to, the connection for each spray head is an arm to the outer end of which that spray head is connected and the inner end of which is pivotally connected to the rotor and has a laterally disposed member to which the cam follower is connected, the cam establishing a path causing the swinging of each arm in a manner to achieve the wanted result.

In the second embodiment of the invention to which reference has been made, linkage is employed to which the cam follower is connected. Each spray head is connected to the rotor a substantial distance from its axis for movement relative thereto to vary the radial spacing of that spray head therefrom. The linkage is pivotally attached to the connection between the rotor and the spray head and is also pivotally connected to the rotor.

It is usually preferred that the connections of the spray heads with the rotor be such that each spray head is swung, to vary its position relative to the rotor axis, in a plane parallel to the conveyor.

As far as we are aware, it has not been recognized, prior to the above referred-to variations in the relation of the spray heads to their arcuate paths, that another cause of unevenness in spray layers was the momentary increase in the pressure on the material being sprayed occurring each time the value of a spray head closed.

Another objective of the present invention is to eliminate that cause of spray layer unevenness, an objective attained by incorporating in each rotor a chamber to receive spray material under a wanted pressure. Each spray head has a conduit in communication with the chamber below the upper end thereof to provide an air cushion of a volume adequate to so absorb the momentary pulses of increased pressure resulting each time a spray head valve closes that there is no momentary increase in the volume of discharged spray material and to serve as an attenuator to minimize a drop in pressure when spray head valves open.

This feature of the invention is useful in minimizing the waste of spray material in any rotary sprayer that does not provide for varying the relation of the spray heads to their arcuate paths but is, of course, best utilized in conjunction with that feature.

BRIEF DESCRIPTION OF THE DRAWINGS

The accompanying drawings illustrate preferred embodiments of the invention of which.

THE PREFERRED EMBODIMENTS OF THE INVENTION

Figure 1:
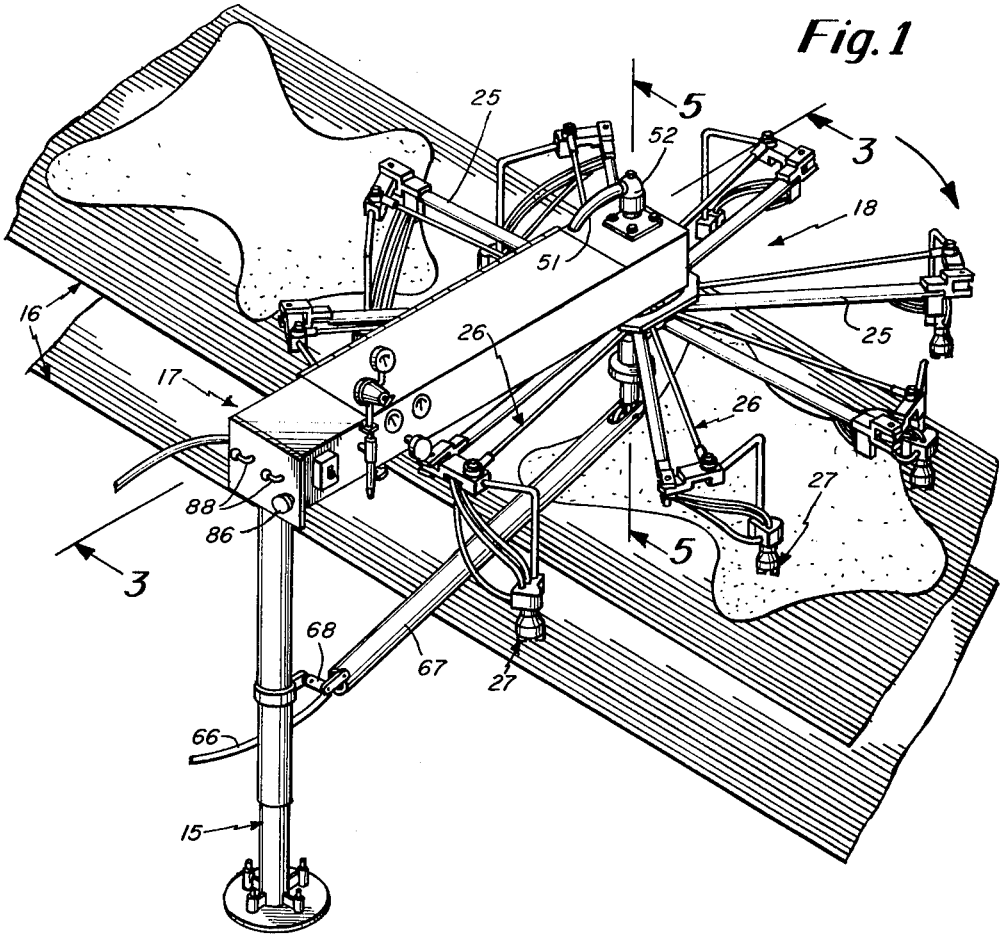
FIG. 1 is a perspective view of an installation in which a rotary sprayer in accordance with the invention is used to spray hides carried by a conveyor.
Figure 2:
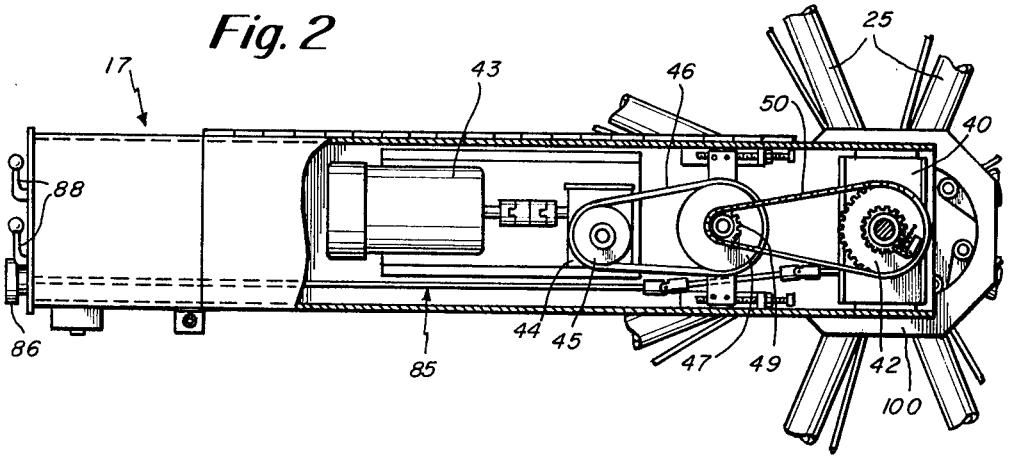
FIG. 2 is a top plan and partly sectioned view of the housing for the rotor drive.

As shown in FIG. 1, apparatus in accordance with the invention has a vertical stand 15 at one side of a conveyor, generally indicated at 16, and a housing 17 extending transversely of and a substantial distance above the upper course of the conveyor. The housing 17 supports a rotor, generally indicated at 18 with the rotor axis normal to the center of the conveyor.

Figure 5:
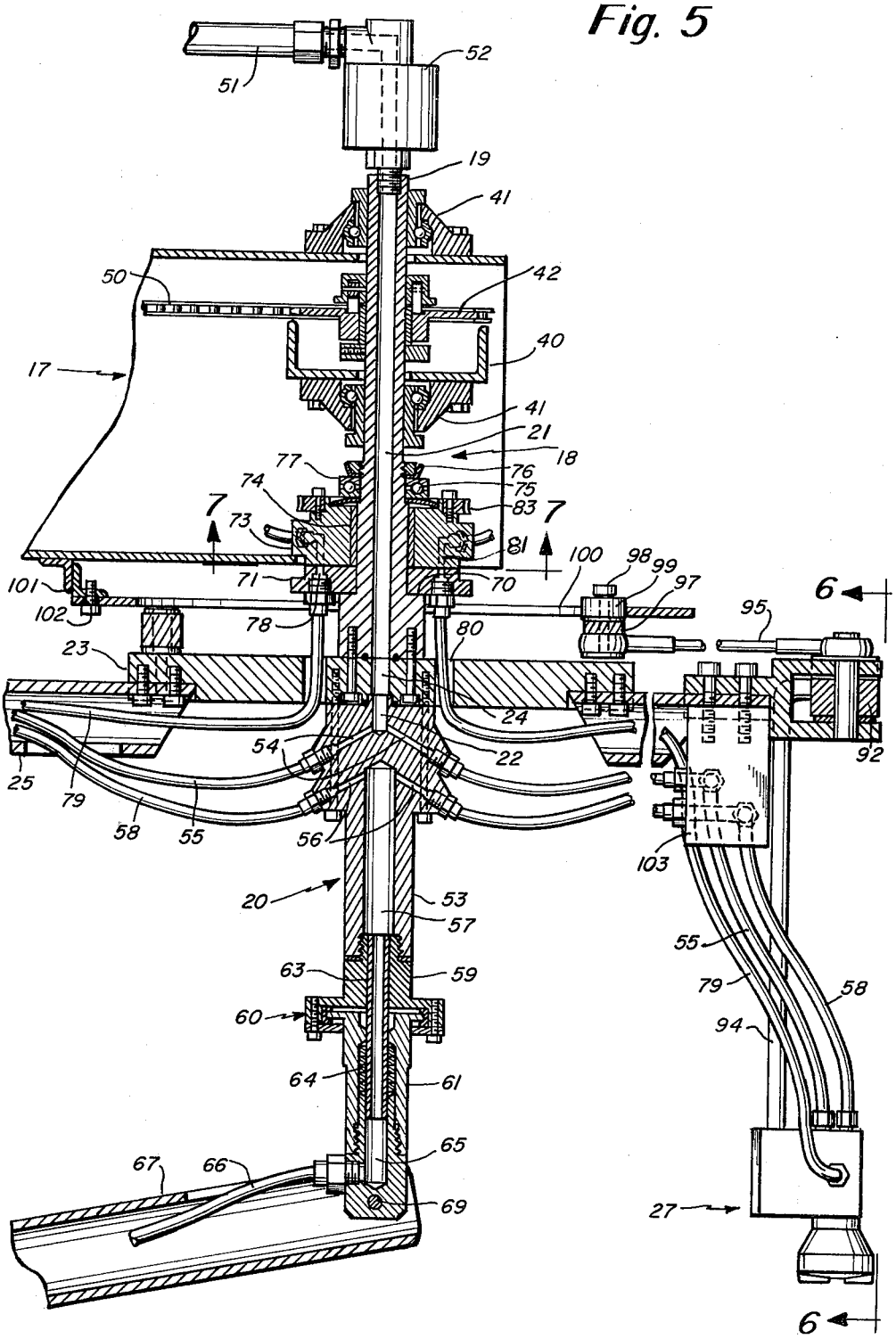
FIG. 5 is a section, on an increase in scale, taken approximately along the indicated line 5—5 of FIG. 1.

The rotor 18, as may best be seen in FIG. 5, includes a vertical upper shaft 19 having an axial bore 21 extending from end to end thereof, a coaxial bottom unit 20 having an axial bore 22 in its upper end, and an intermediate hub or flange 23 having an axial port 24 placing the bore 21 in communication with the bore 22. The rotor hub 23 includes a series of radial tubular arms 25.

A connection in accordance with the invention, generally indicated at 26 and later detailed, supports a spray head, generally indicated at 27 at the outer end of each arm 25. The construction of the rotor sprayer and its functioning may be most readily understood with reference to the construction and wanted operation of the spray heads.

Figure 8:
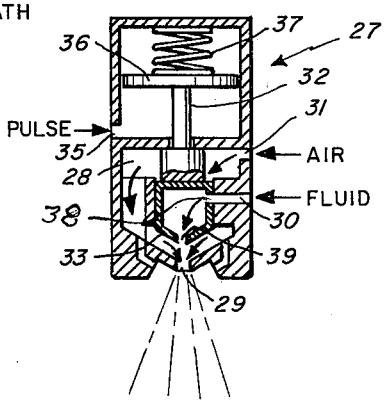
FIG. 8 is a schematic view of a spray head.

For that purpose, reference is made to FIG. 8 wherein a spray head 27 is schematically shown as having a chamber 28 having a nozzle or discharge port 29 and a spray fluid inlet port 30 below an air inlet port 31. The stem 32 of a chambered valve element 33 extends downwardly from an upper chamber provided with a port 35 below the head 36 of the stem 32 which is normally urged downwardly by a spring 37 to seat the chambered valve element 33 to close the discharge port 29 and the fluid inlet port 30 with which a port 38 of the valve element 33 registers when the valve element is raised by admission of air through the port 35 into the upper chamber. The valve element 33 has a restricted outlet port 39 in alignment with the discharge port 29. With this construction, each spray head 27 is normally closed to block the discharge of the spray forming fluids but is readily opened by an air pulse of wanted duration delivered through the port 35.

The shaft 19 of the rotor 18 extends through the bottom and top walls of the housing 17 and through a transverse support 40 mounted therein and is rotatably supported by bearing units 41. The shaft 19 is provided with a sprocket 42. An electric motor 43, mounted in the housing 17 is connected to a gear box 44 driving a Reeves pulley 45 which is connected by a belt 46 to a pulley 47 fast on a vertical shaft 48. The shaft 48 carries a sprocket 49 connected to the drive shaft sprocket 42 by a chain 50.

A conduit 51 from a source, not shown, of air under a wanted pressure is connected by a rotary joint 52 to the upper end of the shaft 19 thus connecting the bore 21 to the conduit 51. The bottom unit 20 of the rotor 18 has, see FIG. 5, a headed section 53 secured to the undersurface of the flange 23 and provided with an upper series of radial ports 54 opening into the bore 22, one port 54 for each spray head port 31 and placed in communication therewith by a conduit 55 and a lower series of radial ports 56 opening into a downwardly opening axial bore 57. There is one port 56 for each spray head 27 and is connected to the spray fluid inlet port 30 thereof by a conduit 58. The bore 57 is counterbored and threaded to receive the threaded upper end of the upper section 59 of the generally indicated rotary joint 60.

A bushed tube 63 extends upwardly through the lower rotary joint section 61 and through the upper section 59. The lower end of the section 61 is counterbored to receive packing 64 against which the threaded end of an end cap 65 of the tube 63 is seated. A conduit 66 from a spray material source, not shown extends through a tubular arm 67 pivotally linked at one end as at 68 to the lower end of the upright 15 with its other end connected to the end cap 65 by a pivot 69 to hold the lower rotary joint section 61 against turning with the rotor 18.

From the foregoing, it will be apparent that as the rotor 18 turns, the spray heads 27 have arcuate paths across the conveyor 16 both upstream and downstream of the rotor axis. In practice, the radial distance the spray heads 27 are spaced from the rotor axis is such that the arcuate spray paths intersect the margins of the conveyor as far from said axis as is practicable. It is apparent that spray is to be discharged not only when a spray head is travelling across the conveyor but also that the discharge of spray may be wanted during only a part of such travel. In addition, it may be desired that spray be discharged only when work is under a spray head or only along one of its spray paths.

In order to control the opening of the spray heads 27 when and where the discharge of spray is wanted, the lower end of the shaft 19 is enlarged to provide a shoulder 70 to which a ring 71 of a generally indicated rotary air control joint 72 is secured. The air control joint 72 also includes a control ring 73 separated from the shaft 19 by a bushing 74 and held under pressure against the upper surface of the ring 71 by a concave spring washer 75 by means of a nut 76 threaded on the shaft 19 with a ball bearing unit 77 between the nut and the washer 75.

The ring 71 has a series of ports 78 extending vertically through it, one for each spray head. Each port 78 is placed in communication with the pulse inlet port 35 of the appropriate one of the spray heads 27 by a conduit 79 extending downwardly through holes 80 in the hub 23.

Figure 7:
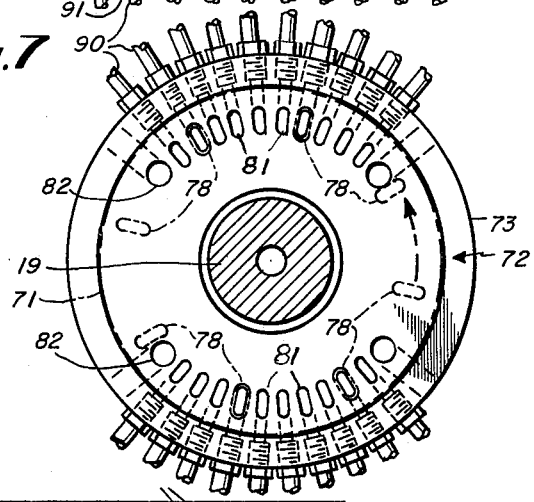
FIG. 7 is a section of the rotary air control joint taken approximately along the indicated line 7—7 of FIG. 5 showing schematically the control of air thereto.

In order to control the discharge of spray when and where wanted along either the upstream or downstream arcuate path, air is dlivered, see FIGS. 5 and 7, through ports 81 opening through the undersurface of the ring 73 in a manner such that when a port 78 of the ring 71 comes into a position to receive air therefrom, a pulse is available to operate the associated spray head with the pulse a duration depending on port dimensions and the rate of rotor rotation. The ring 73 is also provided with relief ports 82.

Figure 3:
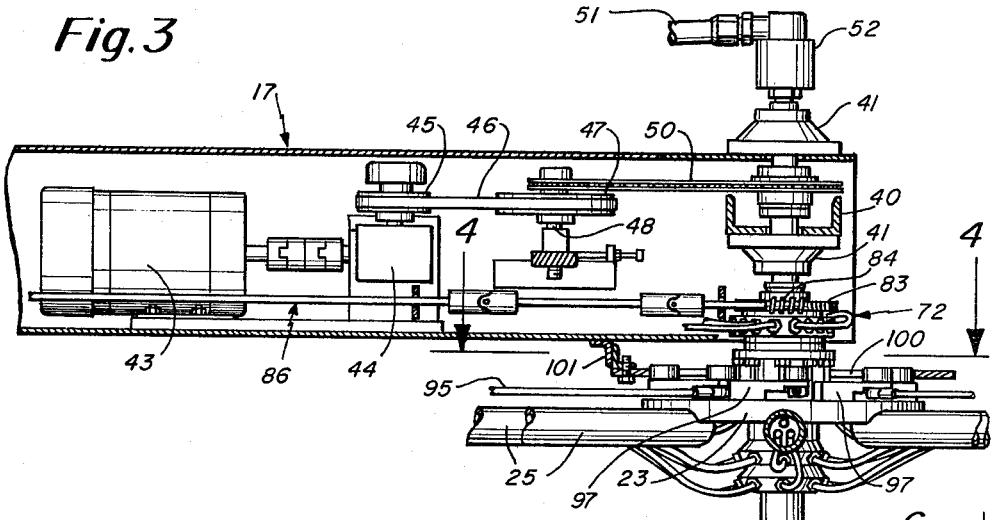
FIG. 3 is a section, on an increase in scale, taken approximately along the indicated line 3—3 of FIG. 1.

In this connection, it will be noted, see FIGS. 3 and 5, that the ring 73 has a worm gear 83 attached thereto and that a worm 84 on a shafting 85 within the housing 17 holds the ring 73 from turning except when the shafting is turned by the manually operated, exposed know 86 by which the relationship of the ring 73 to the conveyor can be adjusted.

In the rotary sprayer as disclosed, there are two like conduits 87 by which air is delivered to the ring 73, one for upstream operation and one for downstream spray head operation, each provided with a manually operated valve 88. One such conduit is schematically shown in FIG. 7 as including a manifold 89 provided with conduits 90, each controlled by a valve 91. The valves 91 may be of a manually operated type or they may be controlled as disclosed in U.S. Pat. No. 4,151,808 to deliver air to the ring 73 only when work is positioned to receive spray.

The rotary spray as thus far described is or may be substantially like that shown and described in the above referred-to patent except for the connections 26 between the rotor 18 and the spray heads 27.

Figure 4:
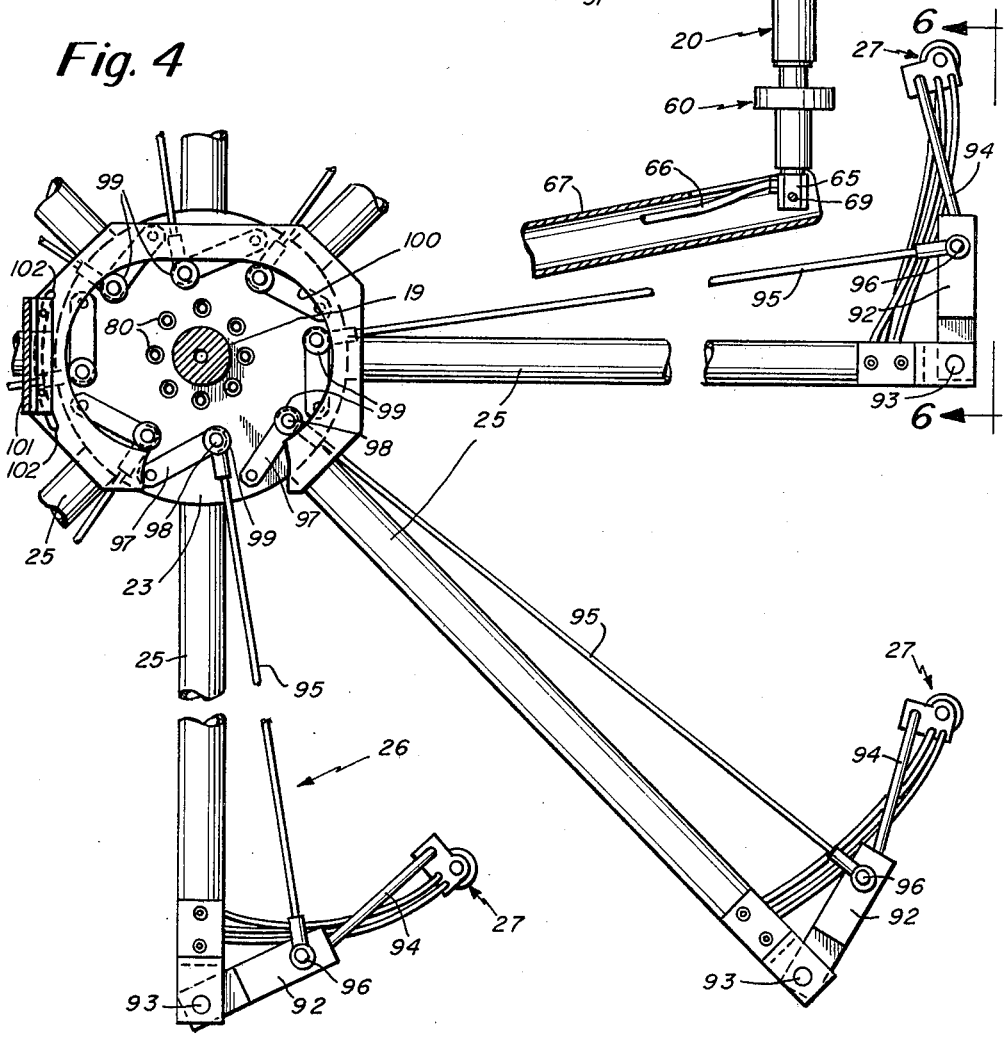
FIG. 4 is a section, on a further increase in scale, taken approximately along the indicated line 4—4 of FIG. 3.
Figure 6:
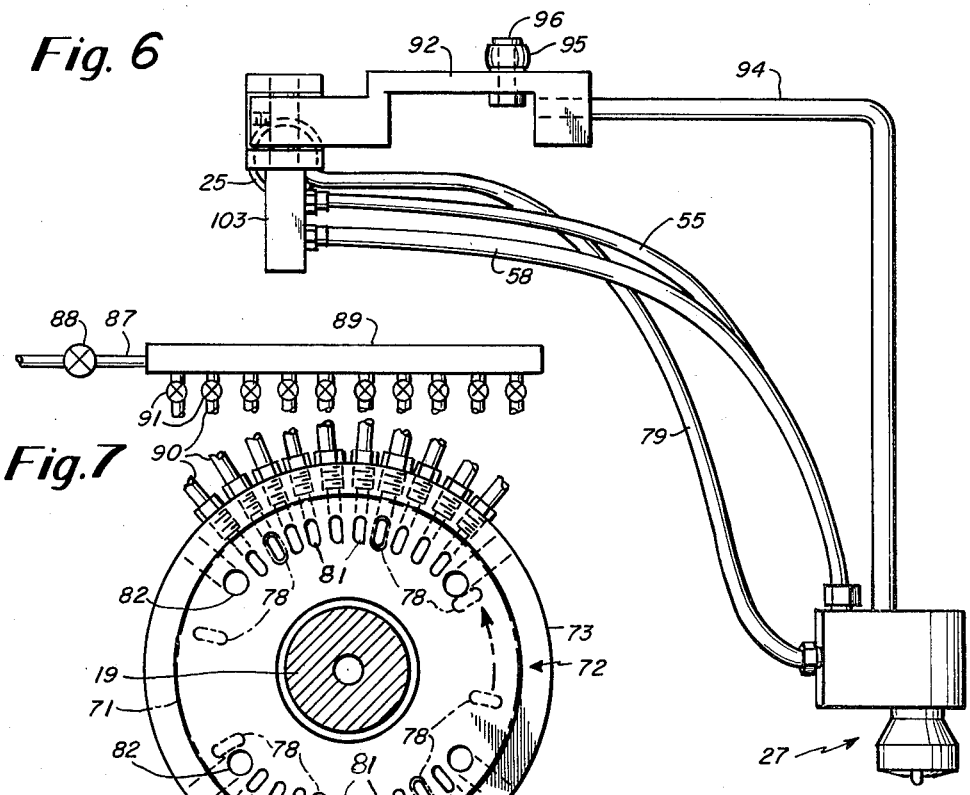
FIG. 6 is a view of a spray head and its connection with the rotor as viewed from the position indicated by the lines 6—6 of FIG. 5.

Each connection 26, see FIGS. 4–6, includes a member 92 with one end extending into a clevis at the outer end of the associated arm 25 and connected thereto by a pivot 93. A right angular support 94 is attached to the outer end of the member 92 and has a spray head 27 attached to its depending end. The member 92 has a rod 95 connected thereto by a pivot 96 and to one end of an arm 97 by a pivot 98. The arm 97 is pivotally connected to the hub 23. The pivot 98 is also provided with a cam follower 99 in engagement with a cam 100 supported by a bracket 101 on the undersurface of the housing 17 to which bracket the cam 100 is connected as by bolts extending through slots 102 enabling the position of the cam track to be adjusted to ensure its correct position relative to the conveyor 16. The cam is shaped and dimensioned, when properly positioned, to effect the swinging of each member 92 in a horizontal plane to vary the radial distance of each spray head 27 as it crosses the conveyor from a maximum adjacent one margin of the conveyor to a minimum centrally thereof and then again increase its radial distance until the maximum distance of that spray head is again attained. Each cam follower 99 is held in engagement with the cam 100, during operation of the sprayer, by centrifugal force. In the disclosed embodiment, the conduits 55, 58, and 79 consist of sections interconnected by couplings 103, one carried by each arm 25.

Figure 9:
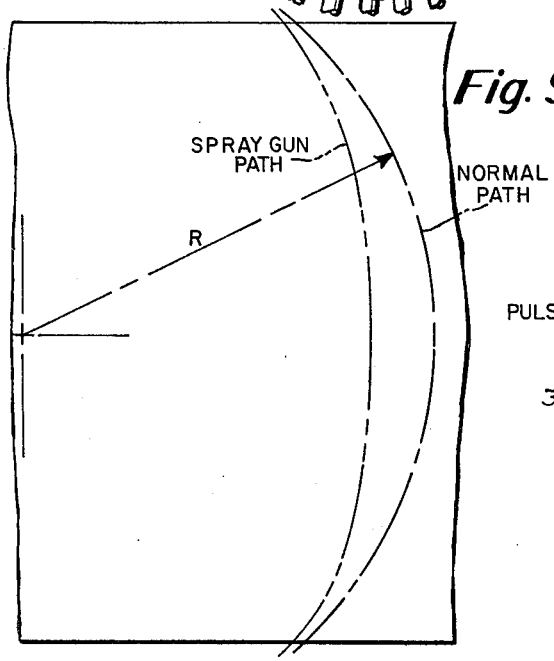
FIG. 9 is a view illustrating the movement of the spray heads relative to their normal arcuate paths.

Reference is made to FIG. 9 wherein the normal spray path is indicated as it would be were each spray head 27 having a fixed position on an arm 25. Because of the varying radial distance betweenn each spray head and the axis of the rotor 18 effected by the cam controlled connections 26, the resulting spray path is shown as having a constantly decreasing radial distance from the rotor axis from a maximum adjacent one margin of the conveyor to a minimum centrally thereof and a constantly increasing radial distance from the rotor axis until a maximum is reached adjacent the opposite margin of the conveyor.

Figure 10:
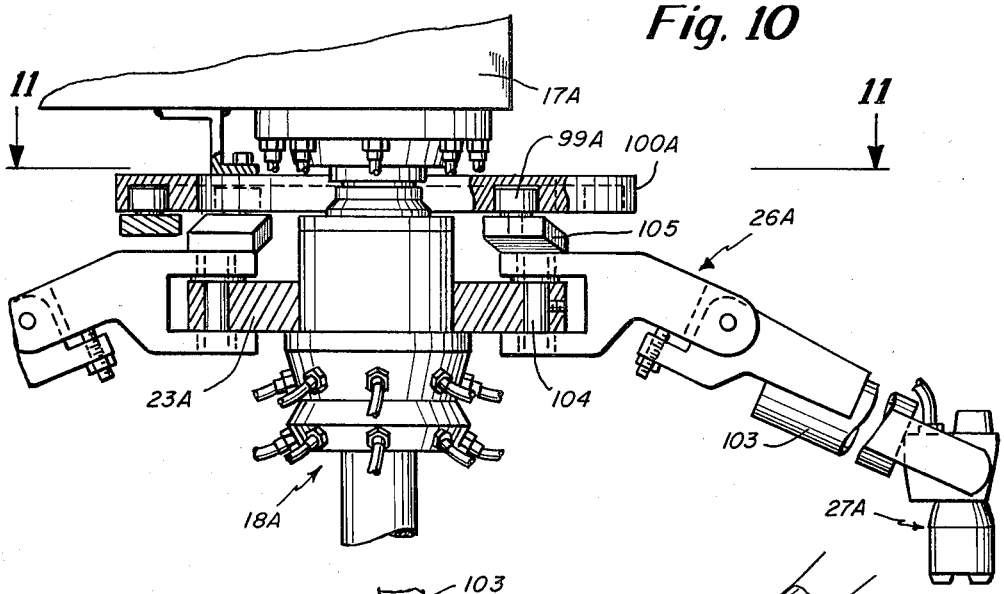
FIG. 10 is a fragmentary and partly sectioned side view of a rotor in accordance with another embodiment of the invention.
Figure 11:
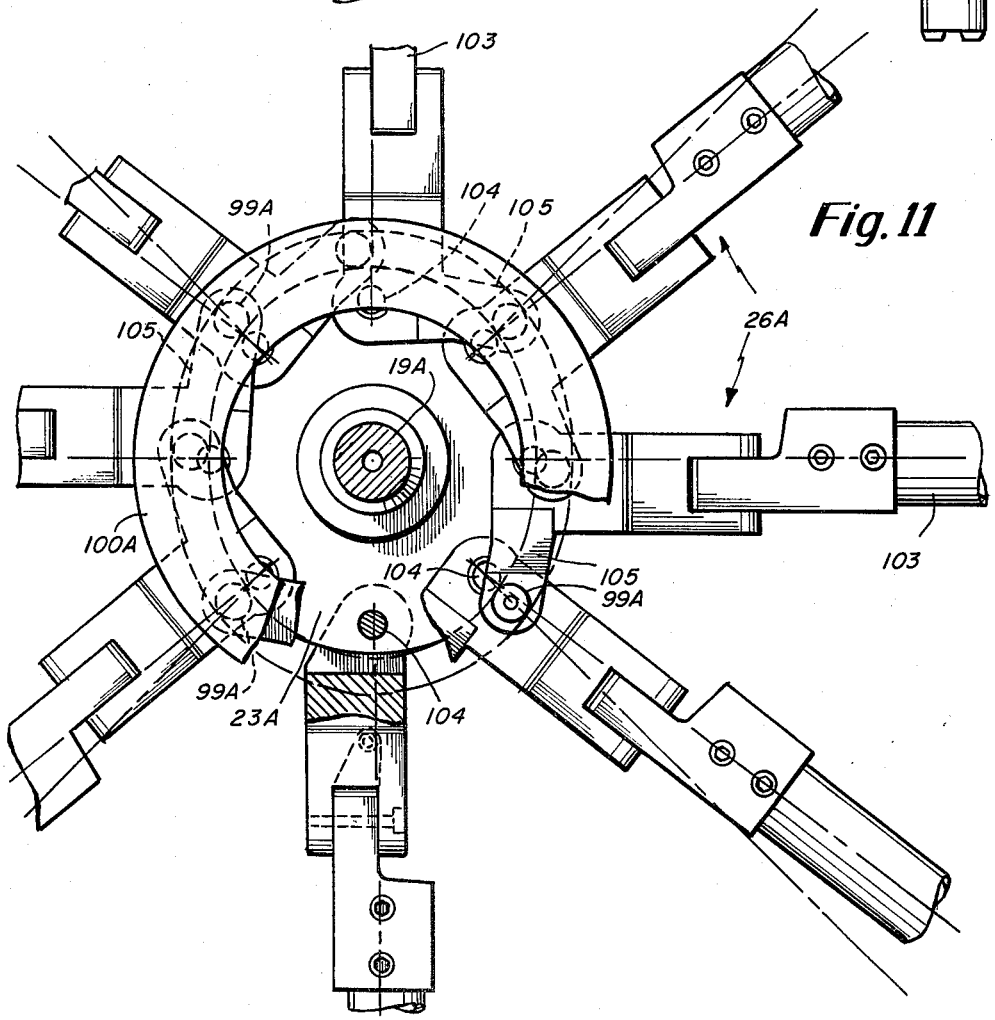
FIG. 11 is a view taken approximately along the indicated line 11—11 of FIG. 10.

In the embodiment of the invention illustrated by FIGS. 10 and 11 the housing, rotor and the means delivering air and fluids to the spray heads and the spray heads are or may be identical to that described in connection with FIGS. 1–9 and are not again detailed and like reference numberals distinguished by the suffix addition A designate corresponding parts.

In this embodiment of the invention, the rotor 18A has the periphery of its hub or flange 23A entrant of clevises at the inner end of arms 103 of the connections 26A and connected thereto by pivots 104. Spray heads 27A are fast on the outer ends of the arms 103.

The inner end of each arm 103 has a member 105 extending laterally thereof substantially at right angles thereto and provided with a cam follower 99A entrant of the cam path 100A attached to the housing 17A. The cam path 100A is so shaped and dimensioned that as a spray head 27A starts across a conveyor it effects the swinging of each arm 103 so that its rate of travel decreases from a maximum adjacent one margin of the conveyor to a minimum centrally thereof at which point, the arm 103 is radial. The cam path then causes each arm to so swing as to effect the gradual acceleration of the travel of its spray head 27A until a maximum rate is attained at the opposite margin of the conveyor.

While the path of the spray heads more nearly conforms to that established if their relationship to the rotor axis were fixed, the end result is again that of a substantially uniformity of deposited spray layers on the work.

Figure 12:
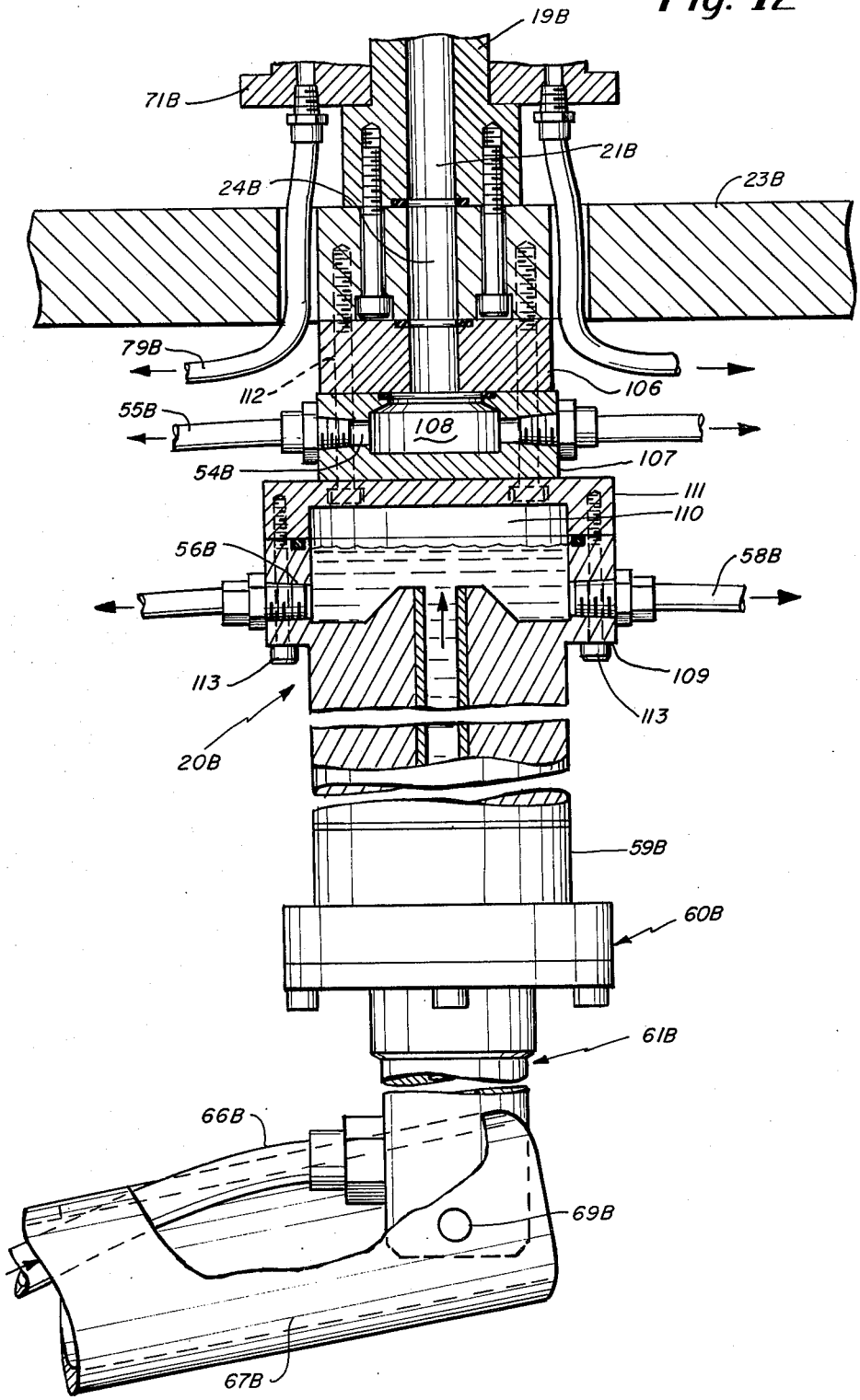
FIG. 12 is a fragmentary vertical section of the rotor illustrating the embodiment of the invention in which the volume of discharged spray material is held constant in spite of momentary pressure variations that occur as the values of spray heads are closed and opened.

The embodiment of the invention illustrated by FIG. 12 is generally siimilar to that illustrated by FIG. 5 and corresponding parts are identified by the appropriate reference numerals distinguished by the suffix addition B.

The bottom unit 20B includes an upper section 106 in the form of a ring and a lower section 107 having an upwardly opening chamber 108 placed in communication with the air passage 21B by the bore of the ring section 106. The chamber 108 has radial ports 54B, one for each spray head, not shown, to which conduits 55B are connected.

A rotary joint 60B connects the section 20B to the fixed section 61B. The upper end portion of the section 20B is of increased diameter providing an exposed shoulder 109 and is formed with a lower upwardly opening chamber section 110. A cover or upper section 111 is secured by bolts 112 which extend through the sections 106 and 107 and into the hub or flange 23B. Bolts 113 extend upwardly through the shoulder 109 of the chamber section 110 and into the upper section 111 to clamp those sections together and incorporate the section 20B in the rotor 18B.

Radial ports 56B adjacent the bottom of the chamber 110, one for each spray head, not shown, have conduits 58B connected thereto with the space above the ports 56B an air chamber of a capacity such that an air cushion is provided adequate both to absorb the momentary pulses of increased pressure resulting as spray heads are successively closed and thus prevent such pulses from being attended by a momentary increase in the volume of material being sprayed and to function as an attenuator to minimize pressure drops as the valves are opened.

We claim:

1. Apparatus for spraying work being carried on a conveyor, said apparatus of a type including a rotor spaced from the conveyor with the rotor axis normal relative to the center thereof, means to rotate said rotor at a constant rate, a series of spray heads, a connection between each spray head and said rotor, said connections spacing said heads from the rotor axis a distance such that the spray heads have arcuate paths across the conveyor upstream and downstream with respect to the rotor axis and means operable to effect the discharge of spray from each spray head as it travels across the conveyor along at least one of said paths, means operable to decrease the radial distance of each spray held from the axis of said rotor from a maximum adjacent one margin of the conveyor to a minimum centrally thereof and then increase said distance to a maximum adjacent the other margin of said conveyor.

2. The apparatus of claim 1 in which the means operable to vary the radial distance between each spray head and the rotor axis includes a cam follower carried by each connection, and a fixed cam engaged by each cam follower during said crossing.

3. The apparatus of claim 2 in which the means operable to effect the discharge of spray from each head includes means to deliver spray material thereto, means to deliver air thereto, a normally closed valve associated with each head in control of said spray material and said air delivery means, and means operable to deliver air to each valve to effect the opening thereof only where wanted during the crossing of the conveyor by said head, and the air operated means includes means delivering air to said heads and a passageway extending axially upwardly through said rotor and provided with an air chamber of a cross sectional area greater than that of said axial passageway, and conduits, one for each spray head and in communication with said chamber below the upper end thereof providing an air cushion of a volume adequate to absorb momentary pressure increases occurring each time a spray head valve closes and to minimize pressure drops as said valves open.

4. The apparatus of claim 2 in which each connection includes a member on which a spray head is mounted, means enabling said member to be so moved as to vary the radial distance between that spray head and the rotor axis and the spray head moving means includes linkage interconnecting said member and said cam follower to said rotor, said linkage operable to effect predetermined variation in said radial distance, and said cam path so shaped as to actuate the linkage first to decrease said radial distance from a maximum adjacent one margin of the conveyor to a minimum centrally thereof and then increase said distance to said maximum adjacent the other margin of the conveyor.

5. The apparatus of claim 4 in which the linkage includes a first link pivotally connected to the rotor and a second link pivotally connected to the first link and said member to effect the swinging thereof to vary the radial distance between said head and the rotor axis.

6. The apparatus of claim 4 in which the linkage and said member swing parallel to tthe conveyor as said radial distance is varied.

7. The apparatus of claim 4 in which the rotor includes fixed outwardly disposed supports, one for each spray head with the member in support thereof pivotally connected thereto.

8. The apparatus of claim 2 and structure by which said rotor is rotatably supported and the cam path at least partially encircles the rotor and is adjustably connected to said structure to enable the cam path to be turned relative to the rotor axis.

9. The apparatus of claim 1 in which the means operable to effect the discharge of spray from each head includes means to deliver spray material thereto, means to deliver air thereto, a normally closed valve associated with each head in control of the flow of said air and spray fluid, and means operable to deliver air to each spray head to effect the opening of the normally closed valve thereof only where wanted during the crossing of the work of that spray head, said spray fluid delivery means including a passageway extending axially upwardly through said rotor and including an air chamber of a cross sectional area greater than that of said axial passageway, and conduits, one for each spray head and in communication with said air chamber below the upper end thereof whereby said upper end provides an air cushion operable both to absorb momentary pulses of increased air pressure occurring each time a spray head valve closes and to minimize pressure drops as spray head valves open.

10. The apparatus of claim 9 in which the rotor includes an upper shaft portion, a coaxial bottom unit and an intermediate hub, said bottom unit includes an upper portion of increased diameter providing a headed section having an exposed bottom shoulder, said headed section including a lower portion of said air chamber and an upper portion thereof detachably connected thereto and to said hub, said bolts extending upwardly through said shoulder interconnecting said chamber portions.

11. The apparatus of claim 10 in which said conduits are connected to said lower portion.

* * * * *